US006398061B2

(12) United States Patent
Duff et al.

(10) Patent No.: US 6,398,061 B2
(45) Date of Patent: Jun. 4, 2002

(54) CANNED AND BOTTLED BEVERAGE HOLDER

(75) Inventors: Scott B. Duff; Carlos E. Ortiz, both of Austin, TX (US)

(73) Assignee: O&D Plastics, Inc., Austin, TX (US)

( * ) Notice: Subject to any disclaimer, the term of this patent is extended or adjusted under 35 U.S.C. 154(b) by 0 days.

(21) Appl. No.: 09/730,693

(22) Filed: Dec. 6, 2000

Related U.S. Application Data

(63) Continuation-in-part of application No. 09/591,921, filed on Jun. 12, 2000, now abandoned.

(51) Int. Cl.[7] ..... F25D 3/00

(52) U.S. Cl. ..... 220/592.16; 220/596.17; 220/737; 220/739

(58) Field of Search ..... 220/592.16, 592.17, 220/592.23, 710.5, 737, 739

(56) References Cited

U.S. PATENT DOCUMENTS

| | | | | | |
|---|---|---|---|---|---|
| 3,766,975 | A | * | 10/1973 | Todd | 220/592.17 X |
| 4,299,100 | A | * | 11/1981 | Crisman et al. | 220/592.17 X |
| 4,383,422 | A | * | 5/1983 | Gordon et al. | 220/592.16 X |
| 4,720,023 | A | * | 1/1988 | Jeff | 220/592.17 |
| 4,771,911 | A | * | 9/1988 | Morony et al. | 220/737 X |
| 5,573,141 | A | * | 11/1996 | Chen | 220/739 X |
| 6,050,443 | A | * | 4/2000 | Tung | 220/592.17 |

* cited by examiner

*Primary Examiner*—Steven Pollard
(74) *Attorney, Agent, or Firm*—Rick B. Yeager

(57) ABSTRACT

A holder for a beverage container, typically a can or a bottle, to provide supplemental cooling to the beverage. The holder includes support ridges, pedestal, or other support means to support the bottom of the can or bottle above the holder bottom to create a space for an ice or an ice and water cooling medium. A sealing means between the holder and the beverage container permits the container and the holder to be tipped for drinking without spilling the ice or ice and water used to provide the cooling.

14 Claims, 2 Drawing Sheets

CANNED AND BOTTLED BEVERAGE HOLDER

RELATED APPLICATIONS

This application is a Continuation-in-Part of application Ser. No. 09/591,921 filed on Jun. 12, 2000, now abandoned.

FIELD OF INVENTION

This invention relates to a holder to keep beverage containers, such as cans and bottles, cool while allowing a user to drink from the can or bottle in the holder without spilling the ice or water used to provide the cooling.

BACKGROUND

An object of the current invention is to provide supplemental cooling to keep a beverage cold.

The embodiments of this invention permit a person to place a can or bottle into a holder along with ice or ice and ice water, and to periodically drink from the can or bottle without spilling the ice or water. A beverage container is placed in the holder, and the seal means provides a sealed enclosure to hold the ice and water.

The embodiments include a compliant seal means which establishes a leak-proof seal between a portion of the beverage can or bottle and the housing.

Typically, the holder cools the drink while it is being consumed. In some embodiments, the housing is outwardly tapered to allow ice water to surround a portion of the beverage container, and to permit the holder to fit into most cup receptacles such as those found in automobiles, boats, and golf carts.

The beverage container is typically supported above the bottom of the holder with tabs that support the bottom of the beverage container.

This offset provides space for a cooling medium such as ice or ice and water. This cooling medium can be replaced in order to provide immediate additional refrigeration to the beverage.

SUMMARY

The embodiments of the current invention include a tumbler housing which is larger than a beverage can or beverage bottle. One embodiment of the invention is a removable sealing subassembly comprised of a compliant seal and a seal containment means which establish a leak-proof seal between a portion of the beverage can or bottle and the housing. The housing includes a support means to support the bottom of the can or bottle above the housing bottom in order to create a space for an ice or an ice and water cooling medium.

BRIEF DESCRIPTION OF THE DRAWINGS:

These and other objects and advantages of the present invention are set forth below and further made clear by reference to the drawings, wherein.

DESCRIPTION OF EMBODIMENT

Can holder with removable seal subassembly.

Figure 1B:
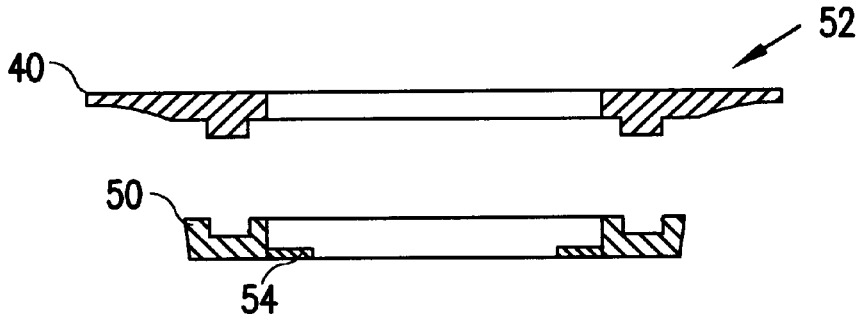
FIG. 1B is a detailed cross-sectional view of the sealing means and the seal containment means of the embodiment of FIG. 1A.
Figure 1C:
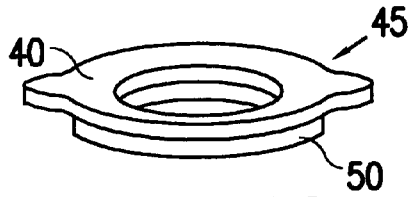
FIG. 1C is a top and bottom perspective view of the tabbed seal subassembly of FIG. 1A.
Figure 1A:
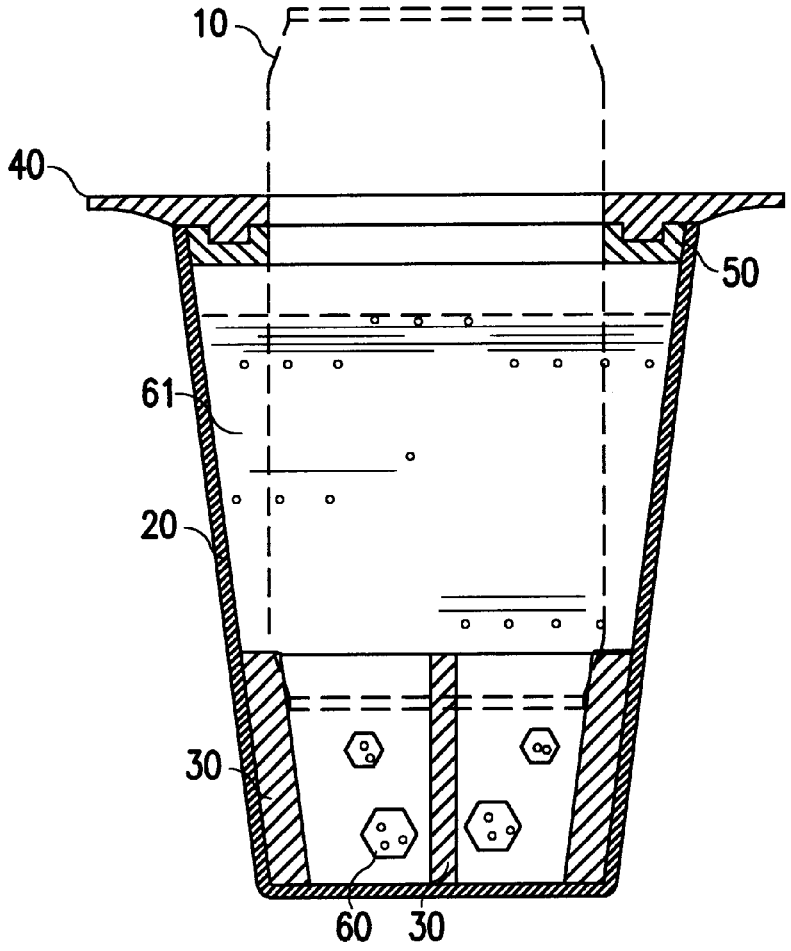
FIG. 1A is a side cut-away view of a beverage can holder with a tabbed seal subassembly.

Referring to FIG. 1A, a can holder embodiment of the current invention includes a tumbler housing 20 that is designed to hold a beverage can 10. The can is supported above the bottom of the housing by three support ridges 30 so that there is room below the can for a water-based coolant of ice, frigid water, or ice and water to be added to the housing in order to provide cooling to the can. The width of the housing is slightly larger than the can to permit additional ice and water to be in contact with a portion of the sides of the can. The housing has an upper opening that is larger than the can, and a seal containment means 40 is placed within a portion of the circumference of this upper opening so that the seal containment means provides support and constraint for a compliant sealing means 50 which is positioned below the seal containment means.

The seal containment means 40 and the compliant sealing means 50 form a seal subassembly 45 that is removable. The seal subassembly serves to hold the can in place as the holder is tipped for drinking from the can, and the sealing means prevents ice 60 and water 61 from escaping from the housing while the user is tipping the holder to drink from the can.

The housing is preferably injection molded from polypropylene, although other materials and production methods may be employed. The housing is preferably in the shape of a tumbler with a bottom diameter of about 2.7 inches so that it will fit into a cup holder such as those found in automobiles, boats, and golf carts. In this embodiment, the can is supported at a height of about 1.4 inches above the bottom of the housing. The support ridges are shown extending to the bottom of the housing in order to permit them to be fabricated with the housing by injection molding. Other support means including pedestals or shelves may be used. The housing has an overall height of about 5.1 inches, so that about 1.1 inches of a standard beverage can is exposed above the housing to permit the user to drink from the can. These dimensions support most 12-ounce beverage cans.

Referring now to FIG. 1B, which is a detailed cross sectional detail of this embodiment, the seal containment means includes a pair of tabs 52 located approximately 180 degrees apart. These tabs provide a leveraging mechanism to assist in removing the seal subassembly from the housing. Lifting a tab also permits the release of positive pressure or negative pressure from the space between the beverage container and the housing, thereby permitting the beverage container and seal subassembly to be removed more easily from the housing.

Referring now to FIG. 1C, a polypropylene seal containment means 40 is separately fabricated, preferably by injection molding. The compliant sealing means 50 is a Dynaflex G7940 thermoplastic rubber compound, Braton™ copolymer, or similar type of compliant material. One method of manufacturing the seal subassembly is to mold the seal containment means and then to over-mold the compliant sealing means over the seal containment means. This process provides a good bond between the seal containment means and the compliant sealing means. The compliant sealing means and the polypropylene seal containment means may be assembled together with other methods such as glue.

In typical operation, either ice or an ice and water mixture is added to the holder before the can is placed in the container. The can is then placed into the top opening until it contacts the support ridges or ice which has been placed in the housing. The support ridges assure adequate space for ice and prevent the can from disappearing into the container. The seal subassembly is then placed over the top of the can so that it engages the can as the seal subassembly is pushed into the housing, thereby creating a seal between the housing and the can.

DESCRIPTION OF EMBODIMENT

Bottle Holder with removable seal subassembly.

Figure 2B:
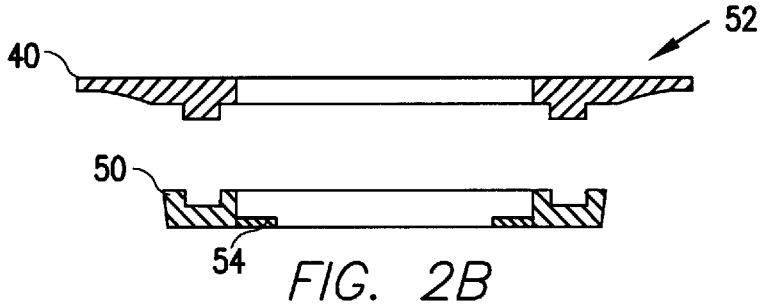
FIG. 2B is a detailed cross-sectional view of the sealing means and the seal containment means of the embodiment of FIG. 2A.
Figure 2C:
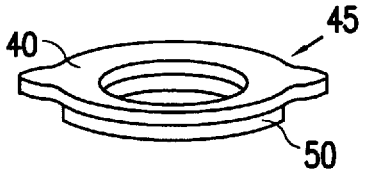
FIG. 2C is a top and bottom perspective view of the tabbed seal subassembly of FIG. 2A.
Figure 2A:
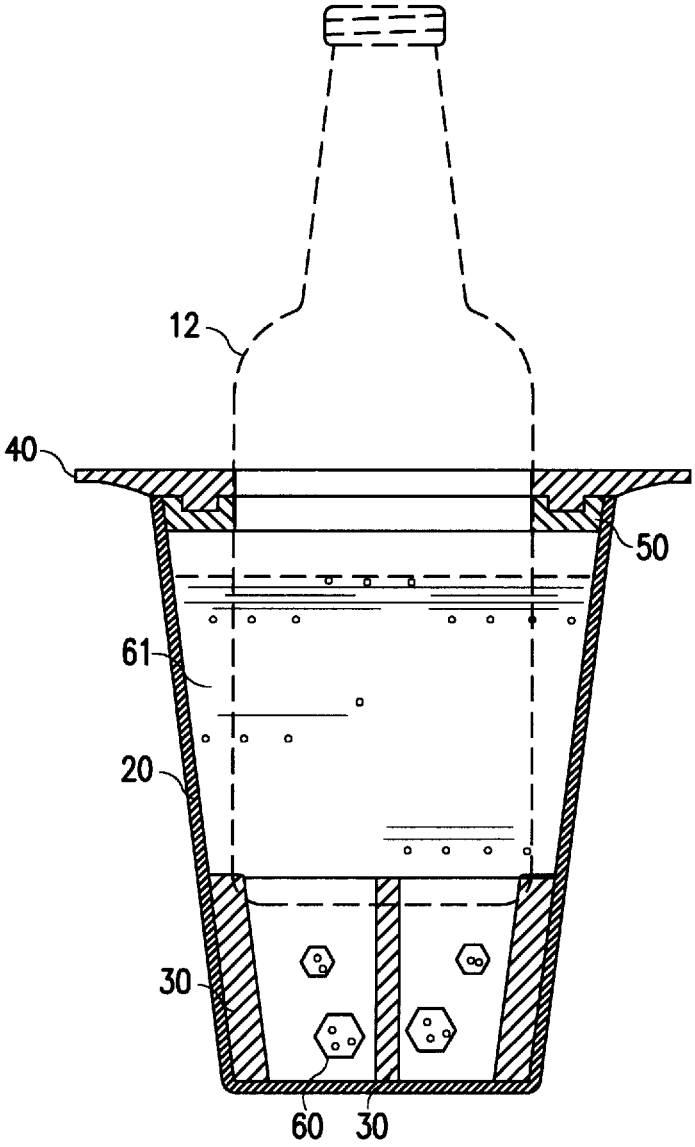
FIG. 2A is a side cut-away view of a beverage bottle holder with a tabbed seal subassembly.

Referring to FIGS. 2A–C, a bottle holder embodiment of the current invention may be produced in the same manner as in the above-described can holder embodiment. A bottle holder embodiment of the current invention may be produced in the same manner as in the above-described can holder embodiment including a tumbler housing 20 that is designed to hold a beverage bottle 12; support ridges 30; a seal subassembly 45 comprised of a seal containment means 40 with tabs 52 and a compliant sealing means 50; ice 60 and water 61.

Referring now to FIG. 2B, in one embodiment, the bottle holder is the same device as the can holder, and flexible flap extensions 54 of the compliant seal adapt to beverage containers of different diameters. For instance, the flexible flap extensions permit the holder to seal against both beverage cans and beverage bottles. In other embodiments, the bottle holder may have a taller housing and a slightly smaller opening in the compliant sealing means to accommodate a bottle.

What is claimed is:

1. A holder for a beverage can comprising a housing such that the beverage can will reside substantially inside the housing, the housing including a bottom, at least one can support means that supports the can above the bottom of the housing, thereby permitting a water-based coolant medium to be placed in the housing, such that a substantial portion of the water-based coolant is positioned below the beverage can, a side wall having an inside surface and an exterior surface, the side wall creating an annular space between a portion of the exterior of the can and the inside surface of the side wall, whereby a water-based coolant can be placed in the annular space and directly contact a portion of the beverage can, and a top opening; and a detachable seal subassembly comprising a sealing means positioned between a portion of the exterior of the can and a portion of the interior of the housing, a seal containment means positioned along the upper circumference of the housing such that the seal containment means reinforces the sealing means and assists in holding the sealing means in place to prevent leakage of the water-based coolant from the annular space when the housing is tilted, and at least one release tab such that the tab may be lifted in order to allow air into the space between the sealing means and the housing in order to release any pressure present to permit removal of the beverage can and the seal subassembly.

2. The holder of claim 1 wherein the housing is tapered.

3. The holder of claim 1 wherein the can support means is a plurality of support ridges.

4. The holder of claim 1 wherein the can support means is at least one pedestal.

5. The holder of claim 1 wherein the coolant medium is ice.

6. The holder of claim 1 wherein the coolant medium is a mixture of ice and water.

7. A holder for a beverage can comprising:

a truncated conical tumbler housing such that the beverage can will reside substantially inside the housing, the housing including a truncated bottom portion having a diameter of approximately 2.7 inches, a side wall having an inside surface and an exterior surface, the side wall creating an annular space between a portion of the exterior of the can and the inside surface of the side wall, at least three support ridges integral to the bottom portion of the inside surface of the side wall, such that the tabs support the bottom of the beverage can above the bottom of the housing, thereby permitting ice and ice water to be placed in the housing, such that a substantial portion of ice and ice water is positioned below the beverage can, a top opening having a diameter of approximately 3.6 inches;

a detachable seal subassembly positioned within a portion of the housing such that the seal subassembly creates a seal between a portion of the exterior of the can and a portion of the housing, thereby preventing leakage of the coolant medium from the annular space when the housing is tilted, the seal subassembly comprising:

a compliant seal means having a flexible flap extension, and a seal containment means having a pair of integral tabs.

8. A holder for a beverage bottle comprising:

a truncated conical tumbler housing such that the beverage bottle will reside substantially inside the housing, the housing including a truncated bottom portion having a diameter of approximately 2.7 inches, a side wall having an inside surface and an exterior surface, the side wall creating an annular space between a portion of the exterior of the can and the inside surface of the side wall, at least three support ridges integral to the bottom portion of the inside surface of the side wall, such that the tabs support the bottom of the beverage bottle above the bottom of the housing, thereby permitting ice and ice water to be placed in the housing, such that a substantial portion of ice and ice water is positioned below the beverage bottle, a top opening having a diameter of approximately 3.6 inches;

a detachable seal subassembly positioned within a portion of the housing such that the seal subassembly creates a seal between a portion of the exterior of the bottle and a portion of the housing, thereby preventing leakage of the coolant medium from the annular space when the housing is tilted, the seal subassembly comprising:

a compliant seal means having a flexible flap extension, and a seal containment means having a pair of integral tabs.

9. A holder for a beverage bottle comprising:

a housing such that the beverage bottle will reside substantially inside the housing, the housing including a bottom, at least one bottle support means that supports the bottle above the bottom of the housing, thereby permitting a water-based coolant to be placed in the housing, such that a substantial portion of the water-based coolant is positioned below the beverage bottle, a side wall having an inside surface and an exterior surface, the side wall creating an annular space between a portion of the exterior of the bottle and the inside surface of the side wall, whereby a water-based coolant bottle be placed in the annular space and directly contact a portion of the beverage bottle, and a top opening; and a detachable seal subassembly comprising a sealing means positioned between a portion of the exterior of the bottle and a portion of the interior of the housing, a seal containment means positioned along the upper circumference of the housing such that the seal containment means reinforces the sealing means and assists in holding the sealing means in place to prevent leakage of the water-based coolant from the annular space when the housing is tilted, and at lease one release tab such that the tab may be lifted in order to allow air into the space between the sealing means and the housing in order to release any pressure present to permit removal of the beverage bottle and the seal subassembly.

10. The holder of claim 9 wherein the housing is tapered.

11. The holder of claim 9 wherein the bottle support means is a plurality of support ridges.

12. The holder of claim 9 wherein the bottle support means is at least one pedestal.

13. The holder of claim 9 wherein the coolant medium is ice.

14. The holder of claim 9 wherein the coolant medium is a mixture of ice and water.

* * * * *